US006193167B1

(12) United States Patent
Sunde

(10) Patent No.: US 6,193,167 B1
(45) Date of Patent: Feb. 27, 2001

(54) PLANT FOR AUTOMATIC SPRAY APPLICATION OF PAINT

(75) Inventor: Alf Sunde, Bryne (NO)

(73) Assignee: ABB Flexible Automation A/S, Bryne (NO)

( * ) Notice: Subject to any disclaimer, the term of this patent is extended or adjusted under 35 U.S.C. 154(b) by 0 days.

(21) Appl. No.: 09/367,097

(22) PCT Filed: Feb. 16, 1998

(86) PCT No.: PCT/IB98/00182

§ 371 Date: Oct. 22, 1999

§ 102(e) Date: Oct. 22, 1999

(87) PCT Pub. No.: WO98/36848

PCT Pub. Date: Aug. 27, 1998

(30) Foreign Application Priority Data

Feb. 24, 1997 (SE) ..... 9700628

(51) Int. Cl.[7] ..... B05B 15/02; F23D 11/34

(52) U.S. Cl. ..... 239/112

(58) Field of Search ..... 239/104, 106, 239/112, 119, 110, 127; 134/169 R, 169 C; 118/302

(56) References Cited

U.S. PATENT DOCUMENTS 4,592,305 * 6/1986 Scharfenberger ..... 118/302
4,932,589 * 6/1990 Diana ..... 239/112
6,037,010 * 3/2000 Kahmann et al. ..... 118/302

* cited by examiner

*Primary Examiner*—Andres Kashnikow
*Assistant Examiner*—Davis Hwu
(74) *Attorney, Agent, or Firm*—Pollock, Vande Sande & Amernick

(57) ABSTRACT

In a plant for automatic spray application of paint through a spray nozzle (12), two parallel lines (9,10) each lead from an associated arrangement (1,2) for supplying paint to the spray nozzle. After paint has been fed through one of the lines to the spray nozzle followed by closing of a valve means (15,16) associated therewith for changing the arrangement (1, 2) supplying paint, a device (24) is adapted to feed such a volume of fluid into this line upstream of the valve means, with respect to the paint feeding direction, in the reverse direction so that the paint present in the line is pushed back into the arrangement without the fluid reaching it.

18 Claims, 1 Drawing Sheet

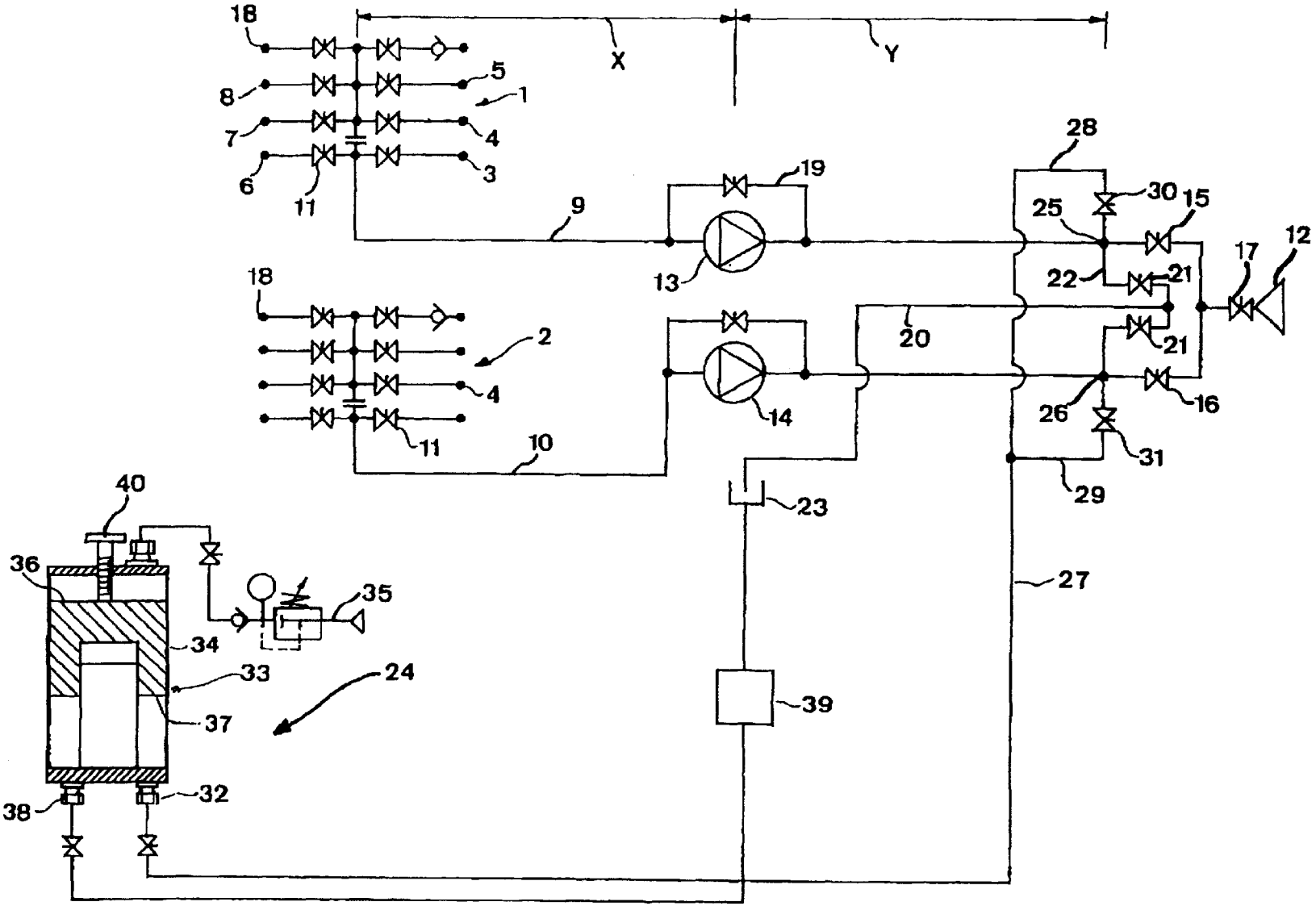
12
17
15
16
30
21
21
31
28
25
22
26
29
27
20
Y
19
14
23
39
13
X
9
10
2
1
5
4
3
4
11
11
18
8
7
6
18
35
24
33
34
37
32
40
36
38

PLANT FOR AUTOMATIC SPRAY APPLICATION OF PAINT

FIELD OF THE INVENTION

The present invention relates to a plant for automatic spray application of paint through a spray nozzle included therein, said plant comprising at least two arrangements for providing paint for spray application connected to the spray nozzle through first supply lines arranged in parallel to each other, means for feeding paint in the respective line from the respective arrangement to the spray nozzle as well as first valve means arranged in the respective line downstream of the feeding means with respect to the feeding direction and controllable to open and close the fluid connection between respective arrangement and the spray nozzle so as to allow spraying of paint coming from one arrangement at the time, as well as a method for automatic spray application of paint.

Such a plant may have different fields of use, but the use of such a plant for painting objects, such as car bodies, by a spray painting robot will hereinafter be mainly discussed for illuminating the invention but not in any way restricting it.

A plant of this type having at least two mutually parallel lines is used primarily so as to reduce the time periods of inactivity when changing paint or color by cleaning one of the lines and make it ready for feeding any new paint it hasn't fed before, while the other of the lines feeds a paint of a certain type to the spray nozzle, so that change of arrangement, i.e. application of a paint of a new type, may take place rapidly.

The arrangements, which usually are constituted by color changing arrangements with a magazine of a series of different paints or colors as well as solvents and valves and regulating means belonging thereto, are most often comparatively bulky and heavy and are bad suited to be placed close to the spray nozzle, for example in the robot case, and for instance when painting car bodies a move of the arrangement to the region of the spray nozzle would mean that the robot couldn't come into and paint the car body internally, so that the first line usually has a considerable length, which for example in the case of spray painting robots for painting vehicles may amount to some meters. When the arrangement providing paint to the spray nozzle is to be changed the paint present in the first line in question is in these plants already known flushed out through the spray nozzle to the exterior and gets completely lost. It is usually sprayed out by flushing the line by a solvent provided by the arrangement. The great length of the first line means that a not negligible volume of paint is lost in this way at each change, which over a longer period of time results in high costs. Furthermore, the paint sprayed out is bad for the environment and smear the surroundings, so that, for example cabins in which painting takes place have to be cleaned relatively frequently. It is not possible to solve this problem with paint losses by spraying the paint out into containers instead, since an unacceptable large amount thereof would be required and the paint is also degraded in the contact with air.

SUMMARY OF THE INVENTION

The object of the present invention is to provide a plant of the type mentioned in the introduction, which finds a remedy to the inconveniences mentioned above of conventional plants.

This object is according to the invention obtained by providing such a plant with a device adapted to, after feed of paint through a first line to the spray nozzle followed by closing the associated valve means for changing to another arrangement providing paint, at a location upstream of the associated first valve means with respect to the spray feeding direction into this first line feed such a volume of a fluid in the reverse direction with respect to the feed that the paint present in this first line is pushed back into the arrangement without the latter being reached by the fluid.

By supplying a fluid to the first line in this way for pushing the paint present in the first line back all the paint pushed back, into the arrangement may be saved and used next time paint of that type is to be supplied to the spray nozzle through the arrangement. It is an important characteristic of the invention that not that much fluid is fed into the first line that also this fluid reaches the arrangement, since that would unacceptably lower the quality of paint in the arrangement. The plant according to the invention not only results in a considerable saving of paint and therefore costs, but the minimal waste of paint is considerate of the environment and cleaning of possible cabins in which the spray application is carried out becomes almost superfluous.

According to a preferred embodiment of the invention the device has means for dosing the fluid for feeding a predetermined volume thereof into the first line in the reverse direction. Such a dosing means is advantageous, since it is extremely important that the volume of fluid fed into the first line in the reverse direction is well adjusted, and the obtaining this is facilitated by such a dosing means.

According to another preferred embodiment of the invention the dosing means is adapted to ensure feeding of a volume of fluid in the reverse direction of the first line substantially corresponding to the volume of this first line from the location of the inlet of the fluid into this first line and to the associated arrangement. A minimum waste of paint is obtained by this design of the dosing means.

According to another preferred embodiment of the invention, the dosing means comprises means for adjusting the predetermined volume of fluid fed by the aforementioned means, which constitutes a simple and reliable realization of the dosing means. It is underlined that "corresponding" is to be given a broad sense and means that the stroke volume is so selected that the fluid fed into the first line exactly manages to push substantially all the paint present in the first line back into the arrangement in question without entering therein itself.

According to another preferred embodiment of the invention, the device comprises means adapted to feed the fluid into the first line with a pressure exceeding the pressure of the paint present in the first line, the means for feeding the fluid comprises a piston cylinder actuated by a pressure medium on the first side of the piston so as to press a fluid located on the opposite side of the piston out of the cylinder, and the surface for the action of the pressure medium upon the first side of the piston exceeds the surface for the action of the piston upon the fluid on the other, second side of the piston for obtaining a pressure increase between the pressure medium and the fluid. For example the compressed air normally already available in an industrial building may by this be used for feeding the fluid into the first line, which also constitutes a further preferred embodiment of the invention.

According to another preferred embodiment of the invention, the device is adapted to feed a fluid in the form of an agent cleaning the first line into the first line in the reverse direction thereof. This is very advantageous, since a flushing of the fluid back out of the first line will then automatically result in a cleaning of the first line, which in any case is necessary before the first line may be filled again by paint of another type for spray application thereof.

According to another embodiment of the invention the device is adapted to feed a solvent into the first line. A cleaning of such a first line by a solvent is normally required, and by using a solvent for pushing the paint back into the arrangement in this way the flushing of the solvent out of the first line may in this way result in an automatic cleaning thereof.

According to another embodiment of the invention the arrangements are color changing arrangements, which constitutes a very preferred application of the plant according to the invention.

According to another embodiment of the invention the plant has a second line connected to the first line through a second valve means and means adapted to, after the pushing back, feed the fluid out of the first line in the ordinary feeding direction for the paint through the second line, a regulating means is adapted to then keep the first valve means closed and the second valve means open, and the regulating means is adapted to only open the second valve means during the feeding of the fluid out of the first line. The fluid may by this be sprayed out of the first line while avoiding that it is emitted into the exterior through the spray nozzle.

According to another embodiment of the invention, which constitutes a further development of the embodiment last mentioned, the plant comprises a collecting vessel for the fluid, and the second line discharges into the collecting vessel. The surrounding may by this be spared from the fluid, which is advantageous in the case of using for example a solvent as fluid, and it is also possible to try to reuse the fluid.

According to another embodiment of the invention, which also constitutes a further development of the embodiment mentioned before the last one, the plant comprises means for conducting the fluid back from the second line to means for feeding it back to one of the first lines when the arrangement providing the spray nozzle with paint is changed next time. Substantially the same fluid may by this be used all the time for pushing the paint back to the arrangements, which is particularly advantageous when this is constituted by a substance harmful to the environment and/or a substance of a non-neglectable cost, so that this embodiment is very well suited when a solvent is used as the fluid.

The invention relates also to a method for automatic spray application of paint according to the appended independent method claim, and the advantages of such a method appear clearly enough from the discussion above of the plant according to the invention.

Further advantages and preferred features of the invention appear from the following description as well as the other dependent claims.

BRIEF DESCRIPTION OF THE DRAWING

With reference to the appended drawing, below follows a description of a plant and a method for spray application of paint according to a preferred embodiment of the invention cited as an example.

In the drawing:

The figure is a schematic diagram of a plant according to the preferred embodiment of the invention.

DETAILED DESCRIPTION OF A PREFERRED EMBODIMENT OF THE INVENTION

The plant schematically illustrated in the figure for automatic spray application of paint is advantageously, but not in any way necessarily, applied to a paint spraying robot for painting for example automobile bodies, and this particular use will be the basis of the description following below. The plant comprises in a way already known two arrangements 1,2 for providing paint for spray application thereof, the arrangements being formed by so called color changing arrangements having a series of sources schematically indicated, such as 3–8, of different paint colors connected to a respective first line 9,10 through valves 11. The color changing arrangements may have a large number of different color sources, which is indicated by the break shown in the respective line. By opening one of the valves 11 the color desired in a particular moment may in this way be supplied to the first line 9,10 in question.

The parallel first feeding lines 9,10 extends from the two paint or color changing arrangements 1,2 to a spray nozzle 12 for a spray application of paint on an object. The plant comprises means 13,14 arranged in each first line 9,10 for feeding paint in the respective line from the respective arrangement to the spray nozzle, in which the feeding means are preferably adapted to establish a dosed feeding of paint to the spray nozzle with a uniform volume flow and are, for the sake for example, constituted by gear pumps. First valve means 15,16 are arranged in a respective first line downstream of the feeding means 13,14 with respect to the feeding direction, and they are controllable to open and close the flow connection between the respective arrangement and the spray nozzle so as to allow spraying of paint coming from one of the arrangements 1,2 at the time. A valve 17 is also connected to the spray nozzle 12.

Each arrangement 1,2 also has a source 18 for a solvent and a bypass line 19 around each pump for enabling clean flushing of the first lines before the color change is carried out at the respective arrangement. The plant has also a second line 20, which is in common to the first lines and connected thereto through a separate second valve means 21 associated with each of the first lines through a branching 22 each connecting thereto. The second line 20 discharges into a collecting vessel 23.

The characteristics of the plant described so far are known from other plants of this type. The two color changing arrangements 1,2 are normally arranged at the base of the robot in question, since they are comparatively bulky and heavy, and the lines 9,10 extend over a considerable distance in the robot arms to the spray nozzle 12 at the free extremity of the last robot arm. This distance is formed by the addition of the distances x and y shown in the figure and is typically 6,000 mm. When using such plants already known paint is sprayed from one arrangement at the time, and when it is changed from for example the arrangement 1 to the arrangement 2 either all paint is sprayed out of the line 9 through the nozzle 12 or it is sprayed to a vessel and disposed of, after which a solvent from the solvent source 18 is flushed through the line 9 around the pump 13 through the bypass line and out into the vessel 23 through the second line 20, while the valve means 15 is closed and the valve means 21 is open, both belonging to the upper branching 22 as seen in figure. This is carried out while the second arrangement 2 provides the spray nozzle 12 with paint, so that the arrangement 1 with the line 9 is ready to provide the spray nozzle with a new color when so required, so that it may be rapidly changed between paints of different colors. Thus, about 120 ml color or paint is typically lost at each color change in such a plant already known, which means a considerable cost per year, since about 200,000 color changes typically takes place during each year in such a spray painting robot.

The new and characteristic features of the plant according to the invention will now be described. The plant comprises a device 24 adapted, after paint has been fed through one of the first lines to the spray nozzle followed by closing the valve means 15,16 associated therewith for changing arrangement providing paint in this first line at a location 25,26 upstream of the associated first valve means 15,16 with respect to the paint feeding direction, to feed such a volume of a fluid therein in the reverse direction with respect to the paint feeding that the paint present in this first line is pushed back into the arrangement 1,2 without the fluid reaching it. The device has for this sake a third line 27, which leads to locations 25,26 of the first lines for feeding fluid thereinto through two branchings 28,29 and a respective third valve means 30,31. Regulating means (not shown) are adapted to open the third valve means when fluid is fed into the first line and otherwise keep it closed. The third line 27 is connected to the outlet 32 of a piston cylinder 33 adapted to cause a dosed feeding of a fluid out into the third line 27 for feeding a determined volume of fluid into the respective first line 9,10. The piston 34 of the cylinder has a first side thereof connected to a pressure medium, preferably compressed air from the ordinary compressed air system 35 of an industrial building. This pressure medium is intended to act upon the surface of the piston at first side 36, in which the surface is larger than the surface acting against the fluid at a second side 37 of the piston. so that a pressure increase is obtained from the pressure medium to the fluid. The fluid pumped in this way out of the piston cylinder 33 is preferably a solvent, which the piston cylinder 33 may receive at an inlet 38 thereof from a distillation apparatus 39 connected to the collecting vessel 23. The piston cylinder 33 is also provided with a set screw 40 for adjusting the predetermined volume of fluid fed by the piston cylinder through adjustment of the stroke volume of the piston cylinder.

The function of the plant according to the invention is as follows. The spray nozzle 12 sprays paint from the arrangement 1, in which the valve in the bypass line 19, the valve 30, the valve 16 and at least the valve 21 in the branching 22 connected to the first line 9 have been closed. When a color change is to take place through changing to paint feeding from the arrangement 2, the following is made with respect to the arrangement 1 and the line 9 thereof. The first valve means 15 is closed, the third valve means 30 is opened and the valve means of the bypass line 19 is opened. The dosing means 33 is after that actuated to feed a predetermined volume of fluid, there in the form of a solvent, through the line 27 into the first line 9 at the location 25 in the reverse direction thereof for pushing the paint in the line 9 back and into the color source of the arrangement 1 belonging thereto. A predetermined volume of solvent is selected so that this does not enter into the color source of the arrangement, but preferably so that it pushes substantially all paint present in the line 9 back into the arrangement 1. The solvent present in the line may after that be flushed through the line 9 and out into the second line 20, in which first the third valve means 30 has been closed and the respective second valve means 21 has been opened before. This is advantageously taken place by supplying any additional solvent from the solvent source 18. The fluid is also utilized for flushing the line 9 clean, so that this gets ready to receive another paint from the arrangement 1 when desired. The solvent reaches the collecting vessel 23 through the second line 20 and is then conducted further to the distillation apparatus 39 for removing paint residuals and the like so as to after that be supplied to the dosing means 33.

The invention is of course not in any way restricted to the preferred embodiment described above, but many possible further modifications thereof would be apparent to a person with ordinary skill in the art, without departing from the basic idea of the invention, Fluid other than a solvent could for example be used for pushing the paint back into the respective arrangement, but it is important that the fluid in question not destroy the paint. When using a water soluble paint, water could, for example, be used as the only fluid. However, it is advantageous to use a fluid that may also be used for flushing the first line clean.

The number of arrangements for providing color could of course be more than two, although it will probably be enough to have two such arrangements to avoiding unnecessary time periods of inactivity when changing paint.

The definition "means for feeding paint in the respective line from the respective arrangement" in the claims is to be given a broad sense and comprises also the case of such a means being constituted by any paint propellant means arranged at the respective arrangement. The feeding means could also be formed by other types of pumps, which could make the bypass lines shown superfluous.

"First supply lines arranged in parallel to each other" means that they are connected in parallel, but they do not have to extend in parallel to each other.

What is claimed is:

1. A plant for automatic spray application of paint through a spray nozzle included therein, said plant comprising:

at least two arrangements for providing paint for spray application connected to the spray nozzle through first supply lines arranged in parallel to each other, means for feeding paint in the respective first line from the respective arrangement to the spray nozzle, first valve means arranged in the respective line downstream of the feeding means with respect to the feeding direction and controllable to open and close the fluid connection between the respective arrangement and the spray nozzle so as to allow spraying of paint coming from one arrangement at the time, a device adapted to, after feed of paint through one of said first lines to the spray nozzle followed by closing the associated valve means for changing to another arrangement providing paint, feed into said one first line at a location upstream of the associated first valve means with respect to the feeding direction such a volume of a fluid in the reverse direction with respect to said feeding direction that paint present in this first line is pushed back into the associated arrangement without the latter being reached by said fluid.

2. A plant according to claim 1, wherein said device has means for dosing said fluid for feeding a predetermined volume thereof into the first line in the reverse direction.

3. A plant according to claim 2, wherein the dosing means is adapted to ensure feeding of a volume of fluid in the reverse direction of the first line substantially corresponding to the volume of this first line from the location of the inlet of the fluid into this first line to the associated arrangement.

4. A plant according to claim 2, wherein said dosing means comprises a piston cylinder having a predetermined stroke volume corresponding to the volume of fluid to be fed into the first line in the reverse direction.

5. A plant according to claim 2, wherein the device comprises means for adjusting said predetermined volume of fluid fed by said dosing means.

6. A plant according to claim 1, wherein the device comprises dosing means adapted to feed the fluid into the first line with a pressure exceeding the pressure of the paint present in this first line.

7. A plant according to claim 6, wherein said dosing means for feeding the fluid comprises a piston cylinder actuated by a pressure medium on the first side of the piston so as to press a fluid located on the opposite side of the piston out of the cylinder, and that the surface for the action of the pressure medium upon the first side of the piston exceeds the surface for the action of the piston upon the fluid on the other, second side of the piston for obtaining a pressure increase between the pressure medium and the fluid.

8. A plant according to claim 1, further comprising a compressed-air-operated cylinder adapted to press said fluid into the first line in the reverse direction thereof.

9. A plant according to claim 1, wherein the device is adapted to feed a fluid in the form of an agent for cleaning the first line into the first line in said reverse direction.

10. A plant according to claim 9, wherein the device is adapted to feed a solvent into the first line.

11. A plant according to claim 1, wherein said arrangements are color changing arrangements.

12. A plant according to claim 1, wherein the plant has a second line connected to the first line through a second valve means and means adapted to, after said pushing back, feed the fluid out of the first line in the ordinary feeding direction for the paint through said second line, wherein a regulating means is adapted to then keep the first valve means closed and the second valve means open, and wherein the regulating means is adapted to only open the second valve means during such feeding of the fluid out of the first line.

13. A plant according to claim 12, wherein said second line is in common to the first lines, and that a separate second valve means is associated with each of the first lines through a branching from the second line connected thereto.

14. A plant according to claim 12, further comprising a collecting vessel for said fluid, and that said second line discharges into the collecting vessel.

15. A plant according to claim 12, further comprising means for conducting the fluid back from said second line to means for feeding it back to one of the first lines when the arrangement providing the spray nozzle with paint is changed next time.

16. A plant according to claim 1, further comprising a third valve means arranged in a line for supply of fluid to the respective first line, and that regulating means are arranged to open said third valve means when fluid is fed into the first line and otherwise keep it closed.

17. A plant according to claim 1, wherein one of said feeding means is arranged in each of the first lines and adapted to establish dosed feeding of paint to the spray nozzle at a uniform volume flow in spray application of the paint from the respective arrangement.

18. A method for automatic spray application of paint through a spray nozzle, said method comprising selectively feeding paint to a spray nozzle from one of at least two arrangements for providing paint for spray application by the spray nozzle, so that spraying of paint from one arrangement at the time is made possible, wherein after feeding paint from one arrangement in a first line to the spray nozzle, when a change is carried out for feeding paint from the other arrangement, the first line is cut-off and a fluid is fed into this line upstream of the location for the cutoff with respect to the direction of said feeding of paint to the spray nozzle, said fluid being fed in the reverse direction with respect to said feeding of paint at such a volume that the paint present in the first line is pushed back into said arrangement without allowing said fluid to reach it.

* * * * *